United States Patent [19]

Mitsuo et al.

[11] 4,335,420

[45] Jun. 15, 1982

[54] CORONA DISCHARGE DEVICE

[75] Inventors: Tanaka Mitsuo, Machida; Tagawa Kazuaki; Yano Takashi, both of Tokyo, all of Japan

[73] Assignee: Ricoh Co., Ltd., Tokyo, Japan

[21] Appl. No.: 209,101

[22] PCT Filed: Jul. 10, 1979

[86] PCT No.: PCT/JP79/00183

§ 371 Date: Mar. 11, 1980

§ 102(e) Date: Mar. 11, 1980

[87] PCT Pub. No.: WO80/00276

PCT Pub. Date: Feb. 21, 1980

[30] Foreign Application Priority Data

Jul. 11, 1978 [JP] Japan ..... 53-84689

[51] Int. Cl.[3] ..... H01T 19/04

[52] U.S. Cl. ..... 361/230; 250/325; 355/3 CH

[58] Field of Search ..... 250/325, 326; 361/214, 361/225, 229, 230, 235; 355/3 CH

[56] References Cited

U.S. PATENT DOCUMENTS

| | | | |
|---|---|---|---|
| 3,335,274 | 8/1967 | Codichini et al. | 250/326 |
| 3,370,212 | 8/1965 | Frank | 361/235 |
| 3,390,266 | 6/1968 | Epping | 250/326 |
| 3,656,021 | 4/1972 | Furuichi et al. | 250/326 |
| 3,942,006 | 3/1976 | Hayne | 250/326 |
| 4,096,543 | 6/1978 | Kozuka et al. | 361/235 |
| 4,233,511 | 11/1980 | Harada et al. | 250/325 |

FOREIGN PATENT DOCUMENTS

| | | | |
|---|---|---|---|
| 2134698 | 1/1973 | Fed. Rep. of Germany | 361/229 |
| 2339745 | 5/1974 | Fed. Rep. of Germany | 361/229 |

*Primary Examiner*—J. D. Miller
*Assistant Examiner*—L. C. Schroeder
*Attorney, Agent, or Firm*—Oblon, Fisher, Spivak, McClelland & Maier

[57] ABSTRACT

The invention relates to a corona discharge device of the scorotron system which is used for electrophotographic copying machines. According to the device the invention, an impedance element 11 is connected between grid wires 6 and the ground, and generates a voltage depending upon a corona current which flows from a corona discharge wire 8 to the grid wires 6. Here, one end of the impedance element is connected to an electrically conductive shielding plate 3. The impedance element is formed in the discharger as a unitary structure, and only one connector is required for the corona discharge wire. Hence, the positioning operation is facilitated and poor electrical connection is avoided.

4 Claims, 7 Drawing Figures

CORONA DISCHARGE DEVICE

BACKGROUND OF THE INVENTION

1. Field of the Invention

The present invention relates to a corona discharge device of the scorotron system used for electrophotographic copying machines, which requires only one connector that connects to a corona discharge wire, and which is adapted to be easily positioned with respect to the main body and is adapted to prevent poor electrical connection.

2. Description of the Prior Art

Corotron and scorotron have widely been known as corona discharge devices. In particular, the scorotron charger has been frequently employed as a discharge device for negatively charging owing to its small dispersion in discharge performance. With regard to the construction, however, a connector for grid wires is separately provided from a connector for corona discharge wire, such that the grid wires are impressed with a constant voltage from an external power supply. Since at least two or more connectors are necessary, the shape of the connector portion tends to become complex. Besides, the device requires clumsy positioning operation and imposes a problem of poor connection.

In view of such circumstances, the object of the present invention is to provide a corona discharge device which requires only one connector to facilitate the positioning operation as well as to prevent the occurrence of poor connection.

SUMMARY OF INVENTION

The present invention deals with a corona discharge device comprising a discharger having a wire for corona discharging, an electrically conductive shielding plate and grid wires; and an impedance element which is connected in series between the grid wires and the ground and which generates a voltage responsive to a corona current flowing into the grid wires; wherein the impedance element is connected between the grid wires and the electrically conductive shielding plate and is formed as a unitary structure in the discharger. Thus, since the impedance element is connected between the grid wires and the electrically conductive shielding plate and is formed as a unitary structure together with the discharger, the connector is needed only for the corona discharge wire, enabling the positioning operation to be facilitated and poor connection to be prevented.

Furthermore, according to the present invention, the impedance of the impedance element is made variable to compensate the aging of photosensitive materials, as well as to change the picture characteristics.

BRIEF DESCRIPTION OF THE DRAWINGS

The drawings illustrate an embodiment according to the present invention; in which.

DETAILED DESCRIPTION

Figure 1:
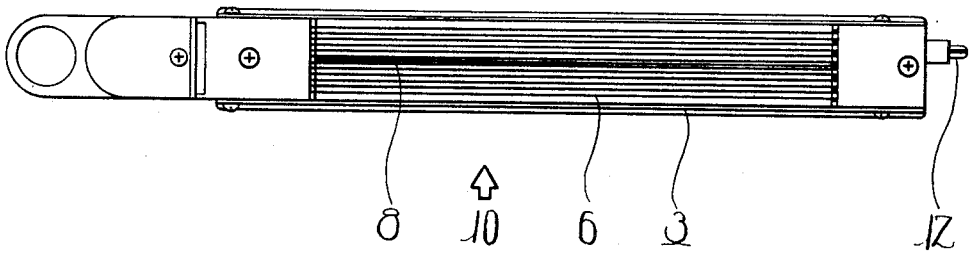
FIG. 1 is a plan view.
Figure 2:
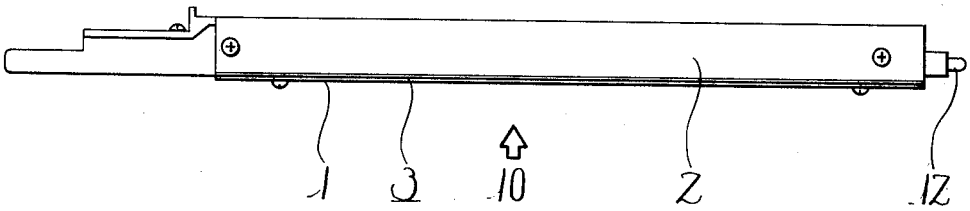
FIG. 2 is a side view of FIG. 1.
Figure 3:
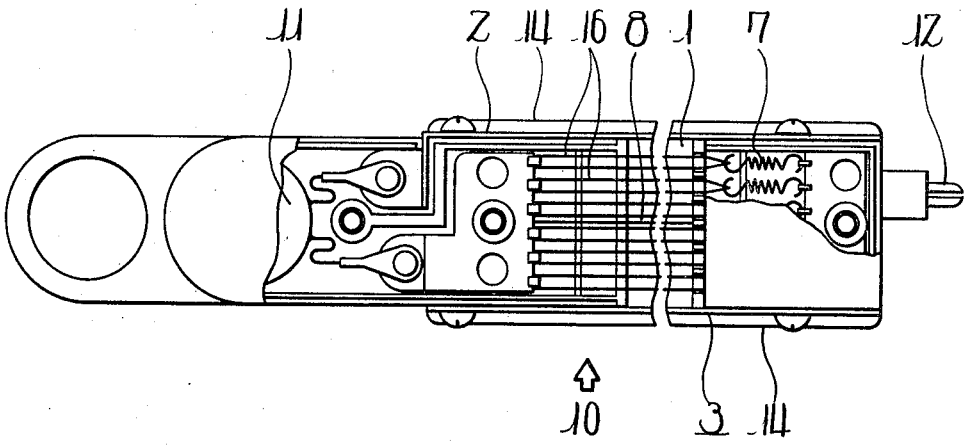
FIG. 3 is a plan view showing, in a partially cut-away manner, the device of the invention on an enlarged scale.
Figure 4:
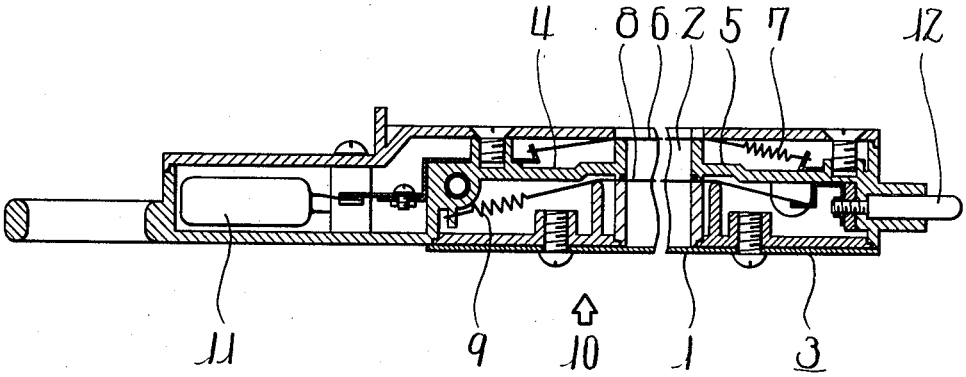
FIG. 4 is a vertically cut-away side view on an enlarged scale.
Figure 5:
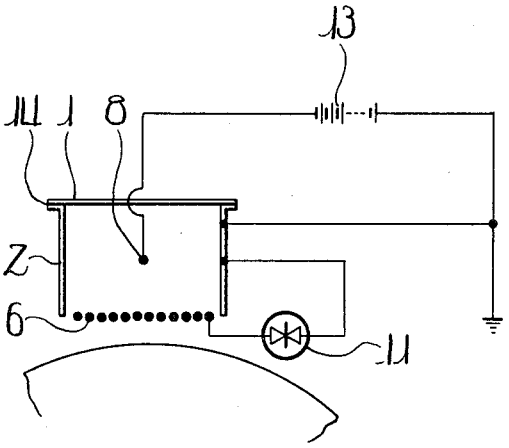
FIG. 5 is a vertically cut-away front view.

An embodiment of the invention is illustrated below with reference to the drawings. Referring, first, to FIGS. 1 to 4, a casing 3 which serves as an electrically conductive shielding plate is formed in a ]-shape by a back plate 1 and side plates 2 (refer to FIG. 5). On both sides of the casing 3 are provided electrically insulating brackets 4 and 5 across which are stretched a plurality of grid wires 6 which are located on the open side of the casing 3 and are pulled by spring 7. Further, nearly at the center of the casing 3, a corona discharge wire 8 is stretched being pulled by a spring 9 between the brackets 4 and 5 in the lengthwise direction of the casing 3. Thus, a discharger 10 of the scorotron system is constructed by the casing 3, grid wires 6 and corona discharge wire 8. A constant-voltage element 11 which is an impedance element is provided at one end of the casing 3. One end of the constant-voltage element 11 is connected to the ends on one side of the grid wires 6, and the other end thereof is connected to the side plate 2. To the other end of the casing 3 is provided, in a protruded manner, a connector 12 to which is connected one end of the corona discharge wire 8. The connector 12 is connected to a high-voltage power supply 13 accommodated in a main body which is not shown. The high-voltage power supply 13 is grounded together with the casing 3. Both ends of the back plate 1 forming the casing 3 serve as engaging portions 14 that will fit to rails formed in the main body which is not shown.

With the thus constructed device, the engaging portions 14 are fitted to rails formed in the main body, and the connector 12 is connected to the high-voltage power supply 13, such that the device is electrically connected to the main body. In this case, only one connector 12 is required, and connectors are not needed for the grid wires 6. As compared with the conventional devices which require a plurality of connectors, therefore, the device of the invention minimizes the probability of developing poor electrical contact, and further enables the positioning operation to be easily carried out. Moreover, since only one connector 12 is required, the device can be simply constructed in small size.

In this embodiment, the constant-voltage element 11 used as impedance element may have either two-way characteristics or one-way characteristics. When the constant-voltage element having one-way characteristics is employed, however, the connecting direction must be changed depending upon the characteristics to be obtained. Examples of the constant-voltage element 11 will be a varistor, Zener diode and the like. The constant-voltage element may further be constituted by a constant-current circuit.

Figure 6:
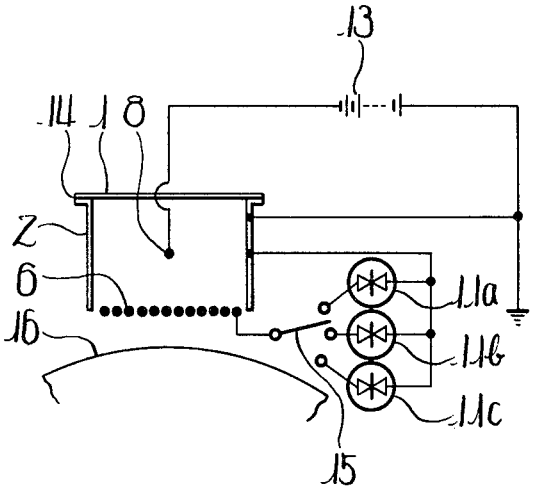
FIG. 6 is a vertically cut-away front view showing a modified embodiment.
Figure 7:
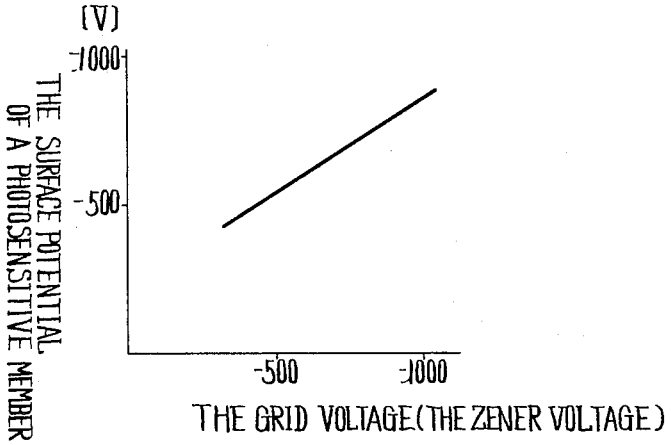
FIG. 7 is a diagram illustrating characteristics.

Further, as shown in FIG. 6, the constant-voltage element 11 may be constructed by a plurality of constant-voltage elements 11*a*, 11*b*, 11*c*,—which will be selected by a switch 15. In this case, if the constant-voltage element 11 is selected by the switch 15 to change the Zener voltage, i.e., to change the grid voltage of grid wires 6, the surface potential of a photosensitive member 16 is controlled as illustrated in FIG. 7. Characteristics illustrated in FIG. 7 are obtained when the casing 3 is made of a zinc-plated steel plate of 0.8 mm in thickness, grid wires 6 are composed of tungsten 0.2 mm in diameter, corona discharge wire 8 is composed of a stainless steel of a diameter of 0.06 mm, the distance of the corona discharge wire 8 to the side plates 2 is selected to be 28 mm, the distance between the back plate 1 and the corona discharge wire 8 is selected to be 11 mm, the distance between the corona discharge wire 8 and the photosensitive member 16 is selected to be 10 mm, the distance between the grid wires 6 and the photosensitive member 16 is selected to be 2 mm, the total discharge current is set to be 800 $\mu$A, and the moving speed of the photosensitive member 16 is 128 mm per second.

Since the surface potential of the photosensitive member 16 can be controlled as mentioned above, it is allowed to compensate the aging of the photosensitive members 16. Namely, for the photosensitive members which increase the surface potential and residual potential with the use, the grid potential should be decreased and for the photosensitive members which decrease the surface potential and residual potential with the use, the grid potential should be increased. In this case, there is no need of intensifying the exposure.

Moreover, when it is desired to obtain pictures with high contrast, the grid potential should be increased to increase the surface potential of the photosensitive member. If the operation is effected in a reverse manner, pictures with soft tone can be obtained. Thus, the device of the invention makes it possible to change the picture characteristics.

The above operation can also be attained by connecting a variable resistor or the like.

What is claimed is:

1. A corona discharge device comprising a discharger having a wire for corona discharging, an electrically conductive shielding plate and grid wires; and an impedance element which is connected in series between said grid wires and the ground and which generates a voltage responsive to a corona current flowing into said grid wires; wherein said impedance element is connected between said grid wires and said electrically conductive shielding plate and is formed as a unitary structure with said discharger.

2. A corona discharge device according to claim 1, wherein said impedance element is made variable.

3. A corona discharge device according to claim 1, wherein a plurality of impedance elements are provided and are selected by a switch.

4. A corona discharge device according to claim 1, wherein a constant-voltage element is used as said impedance element.

* * * * *